US009719690B2

(12) United States Patent
Patil et al.

(10) Patent No.: US 9,719,690 B2
(45) Date of Patent: Aug. 1, 2017

(54) ZONE BASED HEATING, VENTILATION AND AIR-CONDITIONING (HVAC) CONTROL USING EXTENSIVE TEMPERATURE MONITORING

(71) Applicant: NEC Laboratories America, Inc., Princeton, NJ (US)

(72) Inventors: Rakesh Patil, San Francisco, CA (US); Ratnesh Sharma, Fremont, CA (US)

(73) Assignee: NEC Corporation, Tokyo (JP)

( * ) Notice: Subject to any disclaimer, the term of this patent is extended or adjusted under 35 U.S.C. 154(b) by 574 days.

(21) Appl. No.: 14/279,264

(22) Filed: May 15, 2014

(65) Prior Publication Data

US 2014/0379141 A1 Dec. 25, 2014

Related U.S. Application Data

(60) Provisional application No. 61/897,423, filed on Oct. 30, 2013, provisional application No. 61/836,888, filed on Jun. 19, 2013.

(51) Int. Cl.
*G05B 15/00* (2006.01)
*F24F 11/00* (2006.01)

(52) U.S. Cl.
CPC ..... *F24F 11/0009* (2013.01); *F24F 11/0034* (2013.01); *F24F 2011/0073* (2013.01)

(58) Field of Classification Search
CPC ..... F24F 11/001; F24F 11/0034
See application file for complete search history.

(56) References Cited

U.S. PATENT DOCUMENTS 7,809,472 B1 10/2010 Silva et al.
2008/0277486 A1* 11/2008 Seem ..... F24F 11/0009 236/49.3
2010/0070055 A1* 3/2010 Kennedy ..... G05B 15/02 700/90
2010/0274366 A1* 10/2010 Fata ..... G05B 15/02 700/7
2011/0127340 A1* 6/2011 Aiken ..... F24F 11/0001 236/49.3
2013/0085614 A1* 4/2013 Wenzel ..... F24F 11/006 700/277

(Continued)

*Primary Examiner* — Philip Wang
(74) *Attorney, Agent, or Firm* — Joseph Kolodka

(57) ABSTRACT

System and methods for controlling an air conditioning (AC) system includes defining one or more zones to achieve control actions based on local conditions to create a localized dynamic system for localized control, wherein zones are defined by considering hot and cool areas of the room or location of heat generating equipment, wherein the zone definition changes dynamically based on time of day or based on occupancy, or wherein zones are defined in a customizable manner based on sensitivity analysis considering energy savings and comfort tradeoff or considering equipment with predetermined temperature restrictions; monitoring through sensor placement at predetermined locations in the room based on importance of the equipment, heat generation zones and proximity to the AC; determining appropriate temperature setpoints based on existing operating conditions; and applying temperature information at the predetermined locations to generate rules for the actuation of AC systems.

17 Claims, 6 Drawing Sheets

(56) References Cited

U.S. PATENT DOCUMENTS

2013/0274940 A1* 10/2013 Wei ..... G05B 19/02
700/291
2014/0277757 A1* 9/2014 Wang ..... G05D 23/1927
700/276

* cited by examiner

ZONE BASED HEATING, VENTILATION AND AIR-CONDITIONING (HVAC) CONTROL USING EXTENSIVE TEMPERATURE MONITORING

This application claims priority to Provisional Application 61/836,888 filed Jun. 19, 2013 and 61897423 filed Oct. 30, 2013, the content of which is incorporated by reference.

BACKGROUND

The present invention relates to air conditioning control systems.

Creating a sustainable electric energy infrastructure involves the incorporation of renewable energy technologies, various storage technologies and efficient demand management. This report focuses on demand management and in particular on reducing air conditioning energy consumption for room temperature control. The current smart grid technology is undergoing a transformation from a centralized, producer-controlled network to one that is less centralized and more responsive at the local level.

Demand management is an important piece of the smart grid because i) the demand can be regulated to reduce energy consumption, thereby reducing costs, and ii) it provides flexibility to operate storage and intermittent generation resources by reducing or shifting demand. Almost all types of electrical demands have been considered for management. Heating Ventilation and Air Conditioning (HVAC) systems and Electric Vehicle (EV) demands are most commonly considered for management due to their size and the benefits that reducing or managing them offers.

SUMMARY

In one aspect, an HVAC control system includes a flexible and customizable definition of zones that can be easily applied to a wide variety of buildings due.

In another aspect, this system includes extensive monitoring (or sensing) of temperature and humidity in and around buildings. A control method based on the definition of zones and on the extensive sensing determines efficiently controls A/C usage.

Implementations of the above aspect may include one or more of the following. The system reduces air conditioning (A/C) power consumption in large retail and commercial locations while maintaining satisfactory temperatures in the following way. First, different zones are identified for the region in which the temperatures have to be controlled based on various factors such as heating and cooling sources, human occupancy and the location of sensitive equipment (FIG. 1). Next, multiple temperature sensors are installed in each zone of the room based on the above factors and near the A/C vents. Then, the appropriate temperature setpoints are determined based on the existing operating conditions. Finally, the temperature information in the different zones is used by the zone-based control and actuation algorithm to decide the actuation of A/Cs in each zone. The control algorithm decides the actuation signal (FIG. 2) based on the average value of the temperature deviations from the setpoints and the current state of A/C operation. The control decision is made based on temperature rather than room occupancy or time of day which are not as directly related to thermal comfort as the temperature values. The zone based approach utilizes multiple temperature sensor information in each zone resulting in improved monitoring.

Multiple actuating devices can be controlled in each zone resulting in more control flexibility as well as redundancy.

In another aspect, a method for controlling an air conditioning (AC) system, includes defining one or more zones to achieve control actions based on local conditions to create a localized dynamic system for localized control, wherein zones are defined by considering hot and cool areas of a room or location of heat generating equipment, wherein a zone definition changes dynamically based on time of day or based on occupancy, or wherein zones are defined in a customizable manner based on sensitivity analysis considering energy savings and comfort tradeoff or considering equipment with predetermined temperature restrictions; monitoring through multiple sensors placed at predetermined locations in the room based on importance of the equipment, heat generation zones and proximity to the AC; and determining appropriate temperature set-points based on existing operating conditions; and applying temperature information at the predetermined locations to generate an actuation signal for the AC.

Implementations of the above aspect can include one or more of the following. The method includes determining the actuation signal based on an average value of temperature deviations from set-points and a current state of AC operation. The method includes scoping vital locations based on room size and AC placement. The method includes selecting a representative subset of sensors. The method includes applying a rule based control to the AC system, or even using average and max temperature deviation. The method includes building and utilizing a state space model to capture the AC system dynamics. A multivariable PID Control to the AC system can be used. The method includes applying optimization and predictive control to the AC system. Communication between multiple units can be used to obtain a consolidated temperature picture.

Advantages of the system may include one or more of the following. The system provides a monitoring and control application to reduce air conditioning (AC) power consumption while maintaining satisfactory temperatures at desired locations in a building. The system enables lower energy costs due to lower AC power consumption. The reduced power consumption is a result of using extensive sensing information in the control to decide AC usage as well as the localized operation of the controller by defining appropriate zones. In addition, the system also provides increased flexibility to control temperatures by 1) allowing the definition of zones to be based on the particular HVAC needs for the room 2) by choosing desired locations to place temperature sensors in each zone and 2) by choosing the setpoints (reference temperature values) desired at these locations.

Other advantages may include one or more of the following. The system is easily scalable and applicable to rooms and buildings of varying size and configuration. The operation of the system is made reliable by isolating faults at the respective zone(s). The system can be applied with multiple devices in each zone and can provide flexibility and redundancy through the use of multiple devices.

DESCRIPTION

Figure 1:
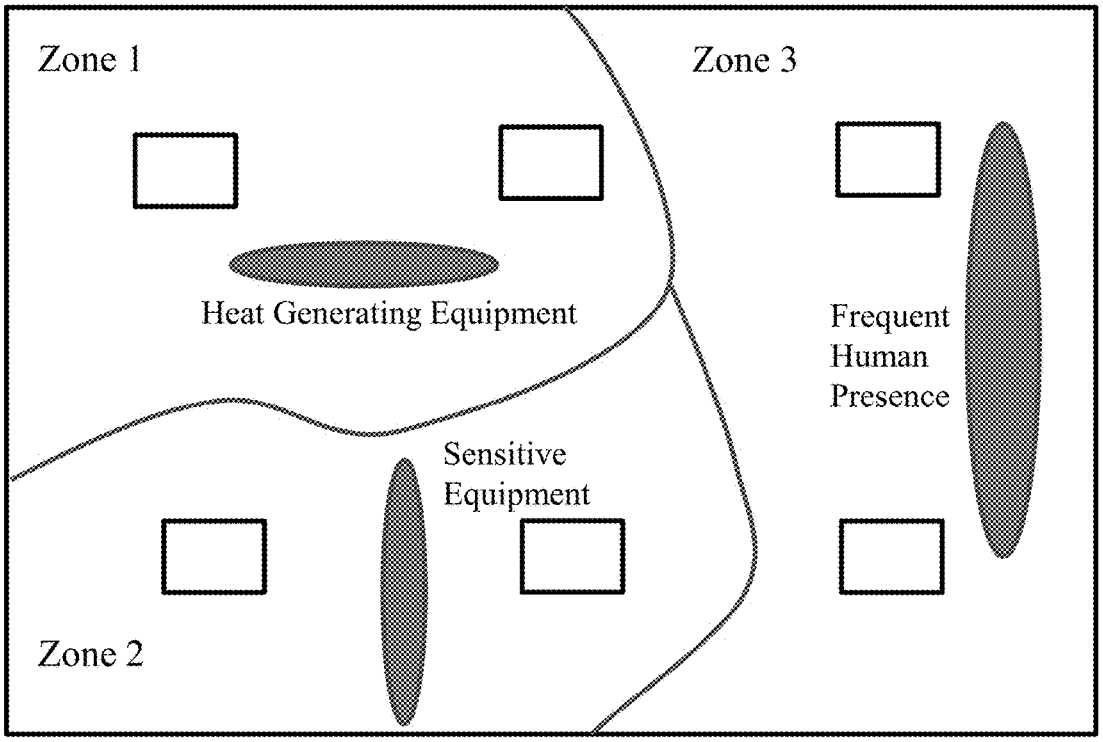
FIG. 1 shows an exemplary zone definition for monitoring and controlling the A/C operation. The system splits the room/building of interest into different zones where the squares represent vents connected to single or multiple A/Cs.

FIG. 1 shows an exemplary zone definition for monitoring and controlling the A/C operation. The system splits the room/building of interest into different zones where the squares represent vents connected to single or multiple A/Cs. The approach to reducing A/C usage is based on two features—extensive monitoring and zone based control. First, multiple temperature sensors are deployed in the building/room of interest to provide an improved temperature picture without the need for a system model. Second, a zone based control approach is developed which is based on flexible definition of zones and results in a generic scalable solution that can be applied to buildings of different sizes and configuration. Our control approach results in efficient A/C operation through extensive monitoring and localized control. In addition, the approach provides redundancy to isolate unforeseen issues such as communication issues to the particular zones. The proposed monitoring and control approach is deployed in telecom base stations and retail stores of different sizes and layouts to highlight the generic nature and scalability of the approach. The energy saving potential and secondary benefits such as flexible localized operation of our unique zone-based control is highlighted in the results. Though the savings vary from 15% to 35% depending on the local conditions and the buildings under consideration our approach is shown to reduce A/C usage in all cases.

The system of FIG. 1 splits the room/building of interest into different zones. The zones are defined in order to cluster similar regions together. For example, if there is certain equipment that constantly generates a lot of heat and that region is generally expected to be at a higher temperature than others, then that part of the room/building can be defined as a zone. Such a definition would localize the conditions—and thereby help the controller act on the local to produce the necessary local conditions in that zone. If such a zone is not defined and the entire area of interest is controlled based on temperature information throughout the room—then this hot region would bias the temperature deviations from desired setpoints and cause the A/C to stay on in regions where it is not necessary. It is also important to note that the definition of a zone is not necessarily dependent on thermal conditions alone. Many other factors such as occupancy (Zone 3 in FIG. 1), sensitivity of the equipment (Zone 2), heat transfer with external regions, air flow conditions, physical separation (like walls) and other such factors can be used to define the zones. Defining the zone should be considered as a way to localize the control actions—thereby resulting in a more efficient and customizable operation than a single controller for the entire area of interest. This flexibility has not been offered in previous approaches. Once the zones are defined, then temperature sensors can be deployed in each zone to provide the thermal description of the zones. A key innovation in our work is that we provide for the flexibility of deploying multiple sensors thereby acting on more information rather than single point sensing through thermostats that is currently employed. These sensors can be placed at locations where the temperatures have to be strictly maintained (e.g. sensitive equipment, high occupancy regions) or through optimal sensor deployment approaches. Once the sensors in each zone are placed and identified, the control algorithm presented below (FIG. 2) is deployed to calculate the A/Cs on/off for each zone.

In this example, the flow of the control algorithm is presented in two pieces which are sequentially executed. First, in this embodiment, temperature data from all the zones and different locations are collected. The controller reads these temperature values (first block on top left in FIG. 1) and preprocesses this data. The preprocessing consists of reading the sensor IDs and checking that these IDs are listed in the file that lists the setpoints for each sensor ID. Then, the sensors readings are separated based on the zone they are assigned to. If some sensor data is missing or certain sensors are not functioning properly their readings are discarded and a useful set of temperature readings is obtained for each zone.

The control algorithm then compares the recorded temperature values with the desired temperature setpoint for each sensor and the positive deviations from the setpoints are collected and averaged for each zone. The controller recommends an on/off signal for each zone based on the value of this averaged deviation. If the average is greater than a threshold, say 0.4 C then an on signal is recommended and an off signal is recommended if the average deviation is 0 C or lower. If they deviation value if between 0 C and 0.4 C then the same signal as the previous time step is recommended. Two other conditions can result in on/off recommendations. First, if any sensor temperature is above an absolute maximum allowed value (say 33 C), then irrespective of other factors A/C is recommended to be on. Second, if all the temperatures are below the absolute maximum allowed and at least one sensor temperature is below the absolute minimum desired (say 22 C), then the A/C is recommended to be kept off even if the averaged deviation is above 0.4 C. This is to ensure that some parts of a zone are not overcooled—which results in additional energy savings.

The recommended on/off signal is then used by the hysteresis part of the controller which finalizes the on/off actuation. The on/off recommendation is delayed by one (or more) time steps, and if the on/off recommendation repeats in the next time step then the A/C is actuated. For example, if the A/C is off and an on signal is recommended because the averaged deviations are greater than 0.4 C, the actuation does not turn on the A/C but waits for the next time step in the off mode. If the on command is repeated in the next time step then the A/C is actuated on. The same logic applies for the off command and can be better understood by following the logic in FIG. 3 below.

In this manner, we utilize multiple sensors' information in each zone processed through our control algorithm to provide an on/off actuation for the A/C devices in each zone. This algorithm is used with A/Cs that can only be turned on/off. For A/C units which operate at commanded temperature levels instead of only on/off, a variation of this algorithm can be developed by mapping the average temperature deviations to the operating range of the A/C.

Figure 2:
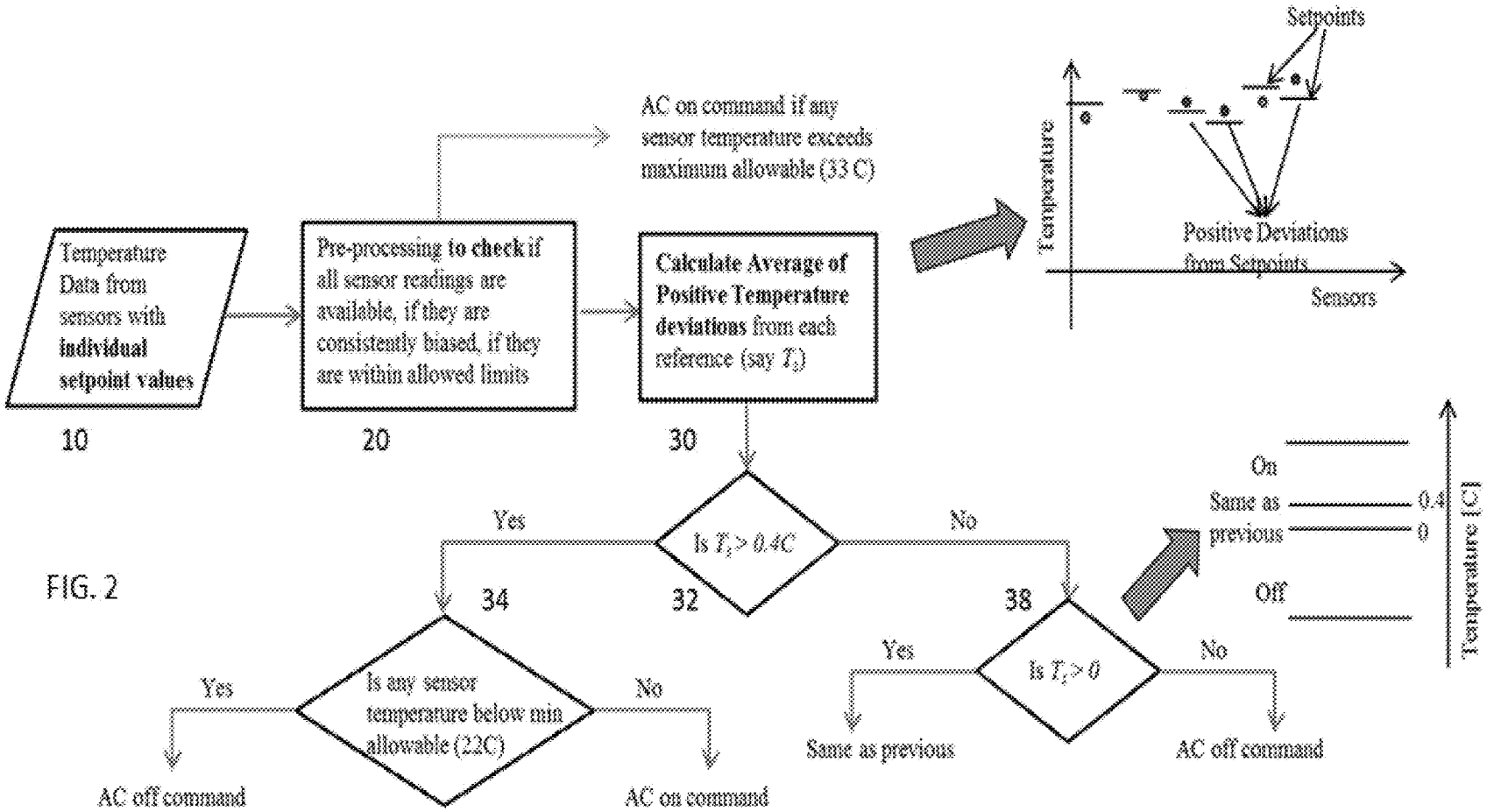
FIGS. 2-3 show exemplary flows of a control algorithm as two pieces which are sequentially executed.
Figure 3:
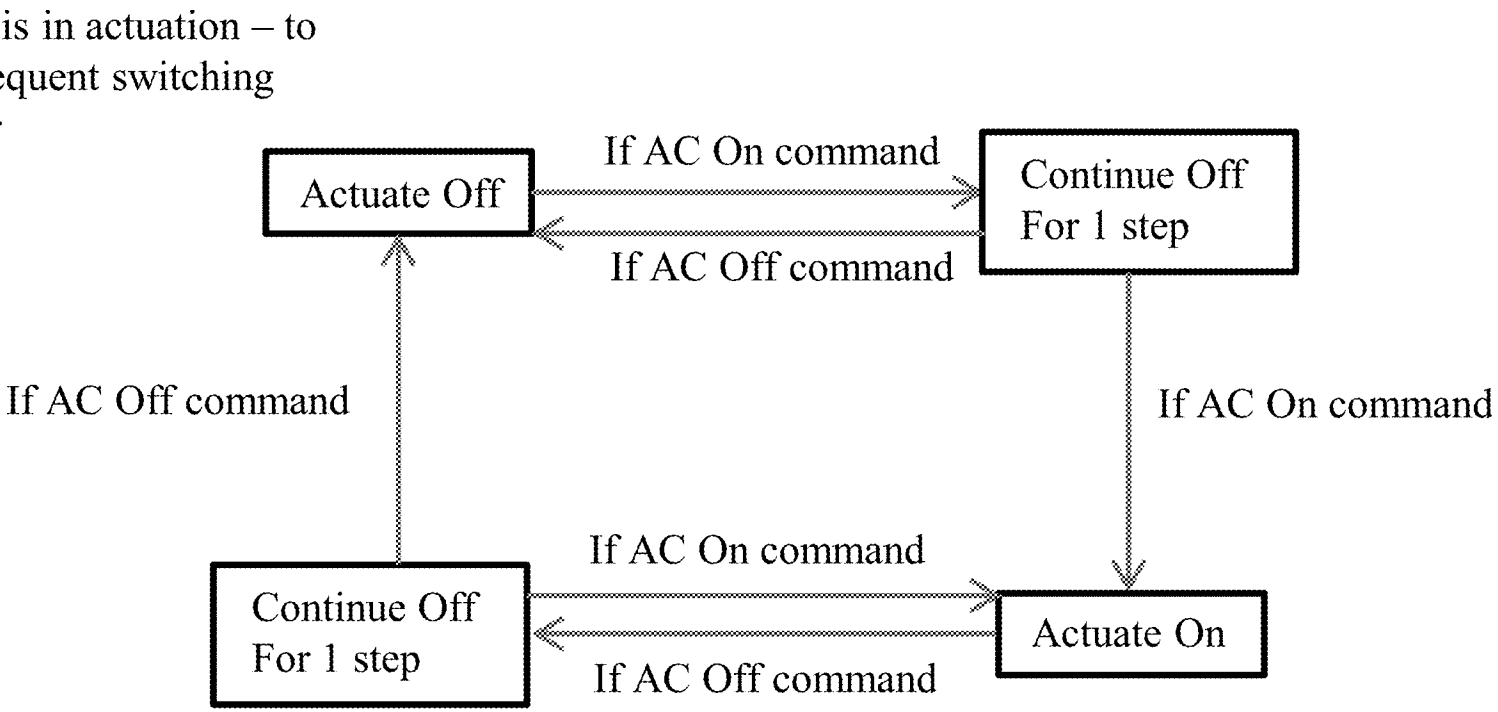

FIGS. 2-3 show exemplary flows of a control algorithm as two pieces which are sequentially executed. The temperature data is collected by a program and saved (10). The control program reads these temperature values and preprocesses the data (20). The preprocessing consists of checking if the data collected match the sensor IDs that are present in the setpoints file. If some sensor data is missing or certain sensors are not functioning properly their readings are discarded and a useful set of readings is obtained. The controller then compares the recorded temperature values with the desired temperature setpoint for each sensor and the positive deviations from the setpoints are collected and averaged. (30) The controller recommends an on/off or 0/1 signal based on the value of this averaged deviation. In one embodiment, the temperature is check for variance within a predetermined range such as 0.4 C (32). If the average is greater than 0.4 C then an on-signal is recommended (34) and an off signal is recommended if the average deviation is 0 or lower (38). If the deviation value if between 0 and 0.4 C then the same signal as the previous time step is recommended. Two other conditions can result in on/off recommendations. First, if any sensor temperature is above an absolute maximum allowed value (which is 33 C for the installed application and is flexible to be changed), then irrespective of other factors AC is recommended to be on. Second, if all the temperatures are below the absolute maximum allowed and at least one temperature is below the absolute minimum desired (22 C for the installation and flexible to be changed), then the AC is recommended to be kept off even if the averaged deviation is above 0.4 C. This is to ensure that some areas of the room are not overcooled which can result in additional energy savings.

As shown in FIG. 2, the recommended on/off signal is then used by the hysteresis part of the controller which gives the on/off actuation. The on/off recommendation is delayed by one (or more) time steps, and if the on/off recommendation repeats in the next time step then the AC is actuated. For example, if the AC is off and an on signal is recommended because the averaged deviations are greater than 0.4 C, the actuation does not turn on the AC but waits for the next time step in the off mode. If the on command is repeated in the next time step then the AC is actuated on.

In this manner, we utilize multiple sensors' information with a rule based control algorithm to provide an on/off actuation. This algorithm is used with ACs that can only be turned on/off. For AC units which operate at commanded temperature levels instead of only on/off, a variation of this algorithm is developed. This algorithm linearly maps the averaged positive deviation to the available set point range as shown below.

Figure 4:
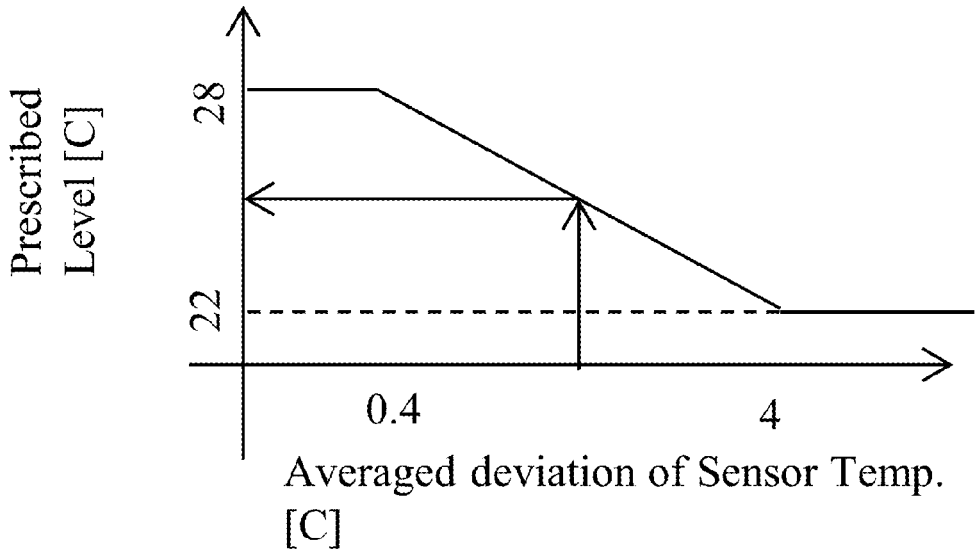
FIG. 4 shows a map based control strategy for devices with adjustable actuation.

FIG. 4 shows a map based control strategy. There is no hysteresis in supplying the AC with the prescribed operating level as the AC is always on in this case and moves to different operating levels. This map based strategy is used for AC with the flexibility to operate at different setting other than just on and off.

Figure 5:
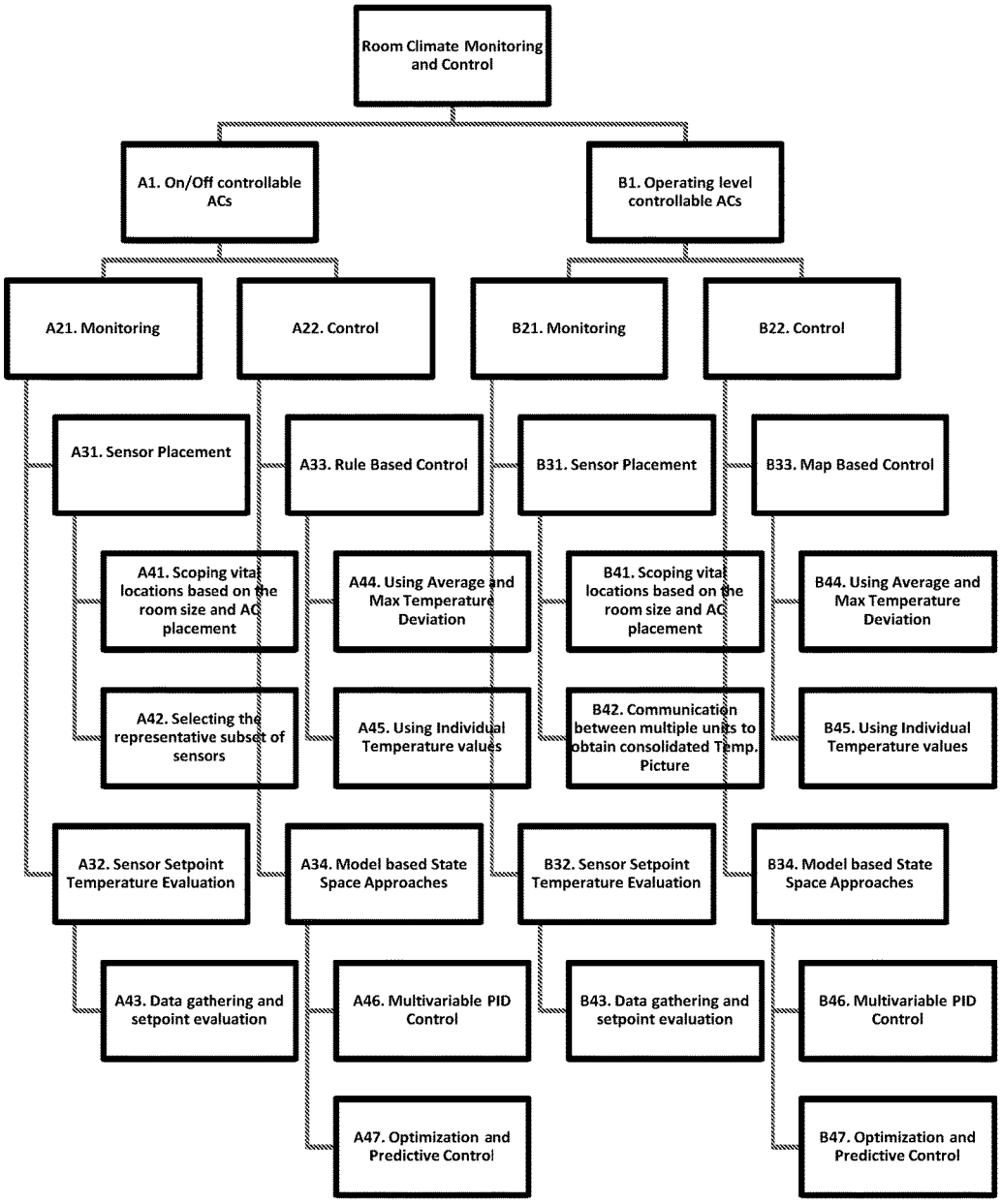
FIG. 5 shows one approach to reduce air conditioning usage based on monitoring and control of the temperature around the room.

FIG. 5 shows one approach to reduce air conditioning usage based on monitoring and control of the temperature around the room. The system locates the sensors and selects a representative group of sensors. In addition the system provides a framework to set up a large number of sensors for bigger rooms and the communication between different units connected to each batch of sensors. In terms of control, the system enables how the information gathered through monitoring is used. The process utilizes all the sensors' data and calculates a metric to turn the AC on/off. This manner of using the information not only results in reduced AC usage but is also flexible enough to be adapted to operate ACs with a map based control. The monitoring and control application can easily be adapted to control the energy demand including other variables such as humidity which are of interest in room climate control.

One embodiment operates on two types on AC (blocks A1 and B1) which are actuated by an on/off command or a desired operating level command (more sophisticated). In each case the monitoring and control are separate important pieces which are integrated to obtain the final solution. The monitoring aspect for A1 and B1 are similar. However, in the case of larger rooms more sensors are required to monitor the temperature around the room better. Thus we will need multiple monitoring applications deployed and the communication between these applications is a necessary step that we have accomplished (block B42). Another aspect related to both monitoring and control is the refinement of sensor readings. In block A42, the selection of a representative set of sensors can be part of the installation before the control is executed so that the control can focus heavily on the representative set of sensors. In a similar manner for the controller, block A45 highlights that instead of developing rules based on averaged or maximum deviation values, rules can be based on individual sensor readings. For example, the AC on command can be weighted more heavily on a certain sensor's behavior.

The control aspects are again similar for A1 and B1. In the case that the AC can act only as an on/off device the control strategy is based on rules depending on the temperature deviations. However a map based strategy is required when the AC has to be provided the level at which to operate. This is explained in more detail in 1a above. Multivariable model based approaches can also be utilized for control (blocks A45, A46, B46, B47) in the developed monitoring and control framework.

The system offers two features:

1. Monitoring: existing technologies utilize the room conditions at a single location or obtain static temperature maps to decide the actuation of the temperature control device (the AC). Our control algorithm utilizes a monitoring framework with multiple sensors around the room to obtain a dynamic picture of the room temperature and other such conditions.

2. Sensor selection and control: Our control methodology to include multiple sensors' information in order to make the AC actuation decision. In this manner we are able to maintain the suitable temperature at the desired locations while efficiently utilizing the air conditioning. Implicitly, we also develop a criterion to select the sensor locations/select the sensors whose readings are more valuable to be acted upon.

Since this is an initial undertaking in demand management, we focus only on reducing the Air Conditioning (A/C) demand through improved temperature monitoring and control. However, this technology is developed with the knowledge that other types of demands can also be monitored and controlled using a framework similar to the one presented in this report.

One embodiment uses a temperature monitoring and control system at telecom base stations (BTS) and at one exchange. At the BTS, the A/C units are on/off type while the exchange had an advanced climate control system which requires the desired temperature level as an input. In addition to this difference, the exchange is a much larger room in size and is more important to the operation of the telecom infrastructure. For this reason more sensors were placed at the exchange to cover the entire area of the room. At one of the BTS 10 sensors are placed and their data was used for control while another BTS was a larger room with 6 A/Cs. Hence 20 sensors are placed there and two controllers are used to control two of the 6 A/Cs.

At the exchange site, due to its size 50 sensors are placed and connected to 5 controller boards. However, only one of the boards is the actual controller and the other four are slave boards which gather the temperature data of the sensors connected to them and transfer this data over ftp to the master board, which provides an operating temperature level. We were not permitted to control the A/C at the exchange. Our system was functional and monitored the data and the outputs, but the controller did not communicate with the A/C. There can be multiple A/Cs in a room and we do not necessarily control every A/C. A relay is used to actuate the A/C and the relay replaces the thermostat in the existing system where the thermostat sends the on or off actuation signal. Depending on the A/C the mode of actuation will differ. At the telecom exchange the climate control system is more advanced and a desired operating level command is the input required by the A/C. The temperature sensors are placed next to the equipment and at different locations in the room where the desired temperature is to be controlled. Since the temperature around the equipment in telecom base stations and exchanges is our primary concern the sensors are placed on the racks. Finally, the controller, which is a Linux-based processor, gathers the data and computes the control command that is sent to the relay, which actuates the A/C. Next we describe each component of this implementation in further detail.

Each temperature sensor is a DS18S20 digital thermometer that provides 9-bit Celsius temperature measurements. The sensors are powered from the data line with a power supply in the range of 3.0V to 5.5V. Every sensor has a unique 64-bit serial code and this ID is tracked and utilized in the control algorithm as well as in the processing the data. In general up to 10 sensors are connected at each controller board as the communications become unreliable when more sensors are connected to the same controller. The sensors are easy to install on walls or to hang.

The relay board has a Power PCB Relay RT1 circuit and is connected to the controller through the one wire adapter. The sensors are connected as a chain to the controller through the one wire adapter.

The monitoring process for the BTS application is a java file that collects the sensor output and writes it to csv and xml files. The monitoring process for exchange application has separate java files for the master and slave boards and communicates through ftp. The temperature data is collected every 30 seconds.

The flow of the control process is presented in two pieces which are sequentially executed. The two pieces are shown in FIGS. 2-3. The control algorithm (written in C) reads these temperature values and preprocesses the data. The preprocessing consists of checking if the data collected match the sensor IDs that are present in the setpoints file which contains the sensor IDs and the desired temperature setpoint at each sensor. If some sensor data is missing or certain sensors are not functioning properly their readings are discarded and the useful subset of readings is retained.

The controller then compares the recorded temperature values with the desired temperature setpoint for each sensor and the positive deviations from the setpoints are collected and averaged. Note that each sensor can have its own setpoint depending on the conditions in the room and the sensor's location. The controller recommends an on/off or 0/1 signal based on the value of this averaged deviation. If the average is greater than 0.4 C then an on signal is recommended and an off signal is recommended if the average deviation is 0 or lower. If the deviation value is between 0 and 0.4 C then the same signal as the previous time step is recommended.

Two other conditions can result in on/off recommendations. First, if any sensor temperature is above an absolute maximum allowed value (which is 33 C for the installed application and is flexible to be changed) then irrespective of other factors A/C is recommended to be on. Second, if all the temperatures are below the absolute maximum allowed and at least one temperature is below the absolute minimum desired (22 C for the installation and flexible to be changed), then the A/C is recommended to be kept off even if the averaged deviation is above 0.4 C. This is to ensure that some areas of the room are not overcooled because it can result in increased energy consumption.

The relay is connected so that it forms a switch to activate or deactivate the power to the A/C. Thus the controller can turn the A/C on/off by sending a I/O signal respectively.

After placing the relay, turning on the power to the A/C, and checking the current and voltage to ensure that power is flowing, we turn the A/C on and off from the command line of the controller which can be accessed through the controller board's serial port. We check that the compressor is turned off by checking the current, by observing the compressor and by observing that the A/C has stopped blowing cool air. We repeat the on/off exercise (2-3 times) to ensure the consistency of the connection.

Once the controller and the relay board are connected to the A/C and the actuation is verified, the controller is started (The controller also starts automatically when the processor board starts). Before starting the controller we check that the variables and the files required to run the controller are appropriately set. These variables are updated based on the temperatures and the sensor IDs for every location. After this initialization the processor is restarted and we observe that the controller executes at startup. In addition, we check if the controller's commands are actually turning the A/C on and off depending on the temperatures at the sensors. The on/off data and temperature data is logged on an external storage device and is analyzed to understand the controller performance.

The monitoring is shown to be reliable for several consecutive days of operation. Utilizing this monitoring data, the controller is shown to execute reliably over a period of days as well. Observing the percentage of A/C on time, A/C usage is reduced by more than 30% at the two base station locations where our solution was deployed. In addition, energy savings of the same order were obtained from the power meter readings that were collected independently of our system.

Figure 6:
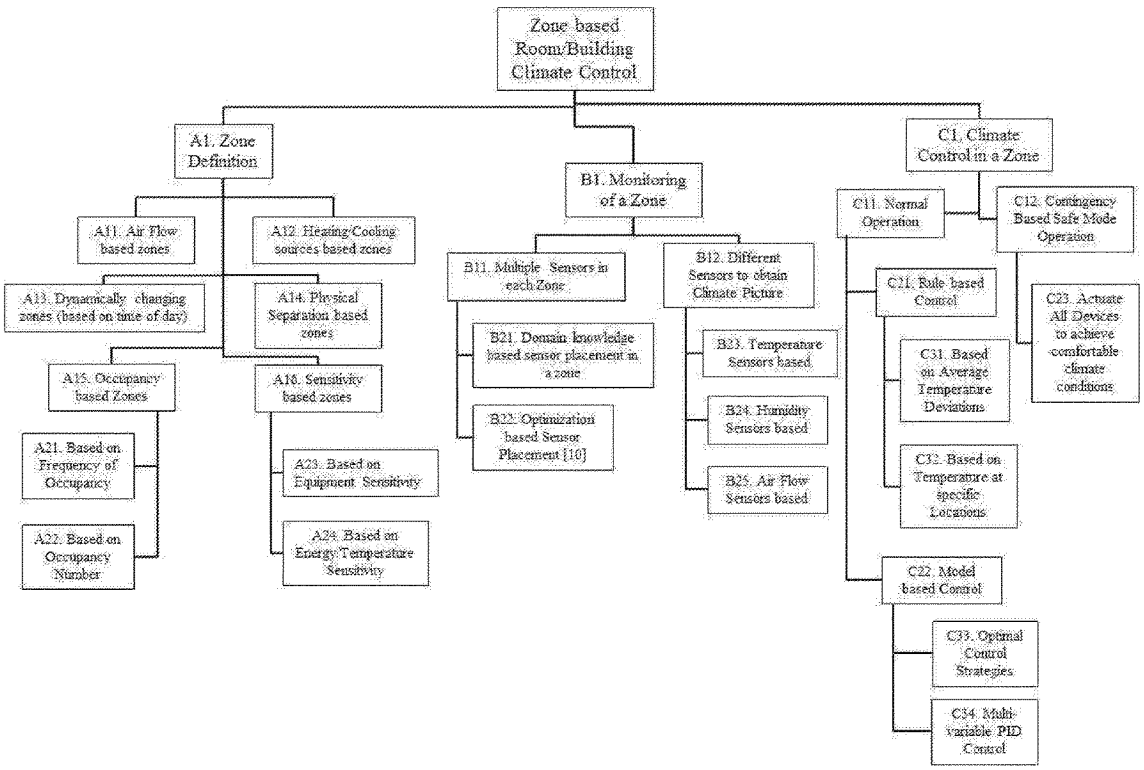
FIG. 6 shows a more exhaustive zone based control approach to reduce HVAC usage based on monitoring and control of the temperature and humidity around the room.

FIG. 6 shows an exemplary process defining a control zone and monitoring approaches used to obtain the climate picture of the zone and the control methods utilized to achieve the desired climate conditions. The approach is applicable to any type of room or building for climate control, and not just temperature control. This is because our approach described above for A/C usage through temperature monitoring and control can be applied to any HVAC device by controlling variables other than temperature such as humidity, air-flow conditions etc. Under block A1, the system uses different approaches to defining a 'zone'. The purpose of defining a zone is to achieve control actions based on local conditions rather than a single controller working with the data for the entire room or building of interest. The zone can be defined based on air-flow conditions (A11) where the air flow between different zones is minimal thereby creating a localized dynamic system lending itself to localized control. Similarly zones can be defined by considering the hot and cool areas of the room or the location of heat generating equipment (A12). The definition of the zones can change dynamically (A13)—for example, based on time of day or based on occupancy and the monitoring and control algorithms can account for that change. The zones can also be defined based on physical separation (A14) such as walls etc. Zones can also be defined based on human occupancy, considering the frequency at which certain areas in a room/building are visited (A15, A21, A22). Finally, zones can be defined in a customizable manner based on sensitivity analysis to optimally consider the energy savings vs. comfort tradeoff (A24) or based on the importance of certain equipment that has stringent temperature restrictions (A23).

Once the zone is defined, monitoring approaches are used to obtain the climate picture for a zone. The system can deploy sensors in each zone (B11) and the type of sensors deployed (B12). Sensors can be deployed based on domain knowledge—i.e. the configuration of a room and specific restrictions regarding the placement of sensors (B21). Sensors can also be deployed through a more rigorous approach to evaluate optimal deployment (B22) as detailed in [10]. Finally, different sensors to evaluate the temperature, humidity and air-flow conditions (B23, B24, B25) in a room can be utilized to get an improved climate picture and hence improved controller performance. The controller acts on the data collected in each zone and regulates the climate in the particular zone. The controller can be operated in a normal mode (C11) or in a safe mode (C21). The safe mode is entered upon contingencies such as issues with sensing or when temperatures are outside the desired operating range. In this case, all the effort is focused on maintaining normal operation in as many zones and achieving a certain comfort level for the troubled zones (C23). This way the impact of contingencies can be localized and corrected. In normal operation, different control strategies can be utilized to control each zone, such as rule based control strategies that utilize the deviations of the temperature readings from their desired values in each zone (C31, C32). A more sophisticated controller can be implemented through a model based approach—which allows for rigorous distributed control (C22). Model based approaches lend themselves easily to optimization (C33) as well as more popular control approaches such as Multivariable PID Control (C34).

We allow for flexible definition of the zones to be controlled—which results in a customizable and scalable solution applicable to any type of room or building. In addition, these zones can be defined based on several different criteria (box A1 and its branches). Previous approaches define zones rigidly based on a particular physical aspect of the room/building and do now allow other considerations in defining zones. The control decision in our approach is based on temperature values rather than room occupancy or time of day. Temperature is the physical variable that describes thermal comfort directly rather than the variables used in existing systems which are not directly related to thermal comfort. Our zone based approach utilizes multiple temperature sensor information in each zone resulting in improved monitoring compared to a single point sensing approach. Multiple actuating devices can be controlled in each zone resulting in more control flexibility as well as redundancy. The zone-based approach results in improved efficiency by controlling the devices based on local conditions and by providing the flexibility to vary the temperature settings locally. The integrated solution of flexible zone definition, extensive monitoring, and multiple sensor based control together solve an important problem of efficient HVAC control based on zones to support local thermal requirements.

Finally, it is important to note that our control system was implemented in places of active business where any interruptions to A/C operation could result in enormous costs. In addition to the energy savings and specific insights on system design, another piece of value addition comes from the fact that our solution works reliably in such practical environments. Several issues not directly related to the control had to be managed in order to accomplish this. Sensor temperature information for a particular zone was unavailable at certain times due to network communication issues. When such an event occurs that particular zone is placed in a "safe mode" where all the relays are actuated to be on till the issue is resolved. In this manner the control system operates the unaffected zones in an efficient manner while reliably operating the affected zone. The alternative with a single zone would be to turn all A/C devices on to ensure desired temperatures reliably. In this manner, a zone based approach provides a reliable solution with improved efficiency.

The invention may be implemented in hardware, firmware or software, or a combination of the three. Preferably the invention is implemented in a computer program executed on a programmable computer having a processor, a data storage system, volatile and non-volatile memory and/or storage elements, at least one input device and at least one output device.

By way of example, a block diagram of a computer to support the system is discussed next. The computer preferably includes a processor, random access memory (RAM), a program memory (preferably a writable read-only memory (ROM) such as a flash ROM) and an input/output (I/O) controller coupled by a CPU bus. The computer may optionally include a hard drive controller which is coupled to a hard disk and CPU bus. Hard disk may be used for storing application programs, such as the present invention, and data. Alternatively, application programs may be stored in RAM or ROM. I/O controller is coupled by means of an I/O bus to an I/O interface. I/O interface receives and transmits data in analog or digital form over communication links such as a serial link, local area network, wireless link, and parallel link. Optionally, a display, a keyboard and a pointing device (mouse) may also be connected to I/O bus. Alternatively, separate connections (separate buses) may be used for I/O interface, display, keyboard and pointing device. Programmable processing system may be preprogrammed or it may be programmed (and reprogrammed) by downloading a program from another source (e.g., a floppy disk, CD-ROM, or another computer).

Each computer program is tangibly stored in a machine-readable storage media or device (e.g., program memory or magnetic disk) readable by a general or special purpose programmable computer, for configuring and controlling operation of a computer when the storage media or device is read by the computer to perform the procedures described herein. The inventive system may also be considered to be embodied in a computer-readable storage medium, configured with a computer program, where the storage medium so configured causes a computer to operate in a specific and predefined manner to perform the functions described herein.

The invention has been described herein in considerable detail in order to comply with the patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A method for controlling an air conditioning (AC) system, comprising:

defining one or more zones to achieve control actions based on local conditions to create a localized dynamic system for localized control, wherein zones are defined by considering hot and cool areas of a room or location of heat generating equipment, wherein a zone definition changes dynamically based on time of day or based on occupancy, or wherein zones are defined in a customizable manner based on sensitivity analysis considering energy savings and comfort tradeoff or considering equipment with predetermined temperature restrictions;

monitoring through multiple sensors placed at predetermined locations in the room based on importance of the equipment, heat generation zones and proximity to the AC; and determining appropriate temperature setpoints based on existing operating conditions; and applying temperature information at the predetermined locations to generate an actuation signal for the AC.

2. The method of claim 1, comprising determining the actuation signal based on an average value of temperature deviations from set-points and a current state of AC operation.

3. The method of claim 1, comprising scoping vital locations based on room size and AC placement.

4. The method of claim 1, comprising selecting a representative subset of sensors.

5. The method of claim 1, comprising applying a rule based control to the AC system.

6. The method of claim 5, comprising using average and max temperature deviation.

7. The method of claim 1, comprising building and utilizing a state space model to capture the AC system dynamics.

8. The method of claim 1, comprising multivariable PID Control to the AC system.

9. The method of claim 1, comprising applying optimization and predictive control to the AC system.

10. The method of claim 1, comprising communication between multiple units to obtain a consolidated temperature picture.

11. An air conditioning (AC) system, comprising:

one or more zones set-up to achieve control actions based on local conditions to create a localized dynamic system for localized control, wherein the zones are defined by considering hot and cool areas of a room or location of heat generating equipment, wherein a zone definition changes dynamically based on time of day or based on occupancy, or wherein zones are defined in a customizable manner based on sensitivity analysis considering energy savings and comfort tradeoff or considering equipment with predetermined temperature restrictions;

one or more sensors through sensor placement at predetermined locations in the room based on importance of the equipment, heat generation zones and proximity to the AC;

code for determining appropriate temperature setpoints based on existing operating conditions; and code for applying temperature information at the predetermined locations to generate an actuation signal for the AC.

12. The system of claim 11, comprising code for determining the actuation signal based on an average value of temperature deviations from the setpoints and a current state of AC operation.

13. The system of claim 11, comprising code for selecting a representative subset of sensors.

14. The system of claim 11, comprising code for applying a rule based control to the AC system.

15. The system of claim 14, comprising code for using average and max temperature deviation.

16. The system of claim 11, comprising code for applying optimization and predictive control to the AC system.

17. The system of claim 11, comprising code for communication between multiple units to obtain a consolidated temperature picture.

* * * * *